United States Patent [19]

Westimayer

[11] 4,441,266

[45] Apr. 10, 1984

[54] SKID SHOE MOUNTING ARRANGEMENT FOR SNOW BLOWER

[75] Inventor: David A. Westimayer, Horicon, Wis.

[73] Assignee: Deere & Company, Moline, Ill.

[21] Appl. No.: 444,947

[22] Filed: Nov. 29, 1982

[51] Int. Cl.[3] ..... E01H 5/09

[52] U.S. Cl. ..... 37/244; 37/271; 172/393; 172/744

[58] Field of Search ..... 37/244, 263, 270, 271; 172/393, 744

[56] References Cited

U.S. PATENT DOCUMENTS

| | | | |
|---|---|---|---|
| 1,687,169 | 10/1928 | Marran | 37/271 |
| 2,460,560 | 2/1949 | Williams | 37/271 X |
| 3,011,273 | 12/1961 | Stumpf | 37/271 X |
| 3,078,603 | 2/1963 | Ertsgaard et al. | 37/270 X |
| 3,490,057 | 1/1970 | Kahlbacher | 37/271 X |
| 3,858,662 | 1/1975 | Reid | 37/271 X |
| 3,938,400 | 2/1976 | Konyha | 37/244 X |

*Primary Examiner*—Edgar S. Burr
*Assistant Examiner*—Moshe I. Cohen

[57] ABSTRACT

A skid shoe mounting arrangement detachably mounted to the side of the snow blower auger housing such that the skid shoe mounting assembly can be easily reassembled to a plurality of preset heights relative to said auger housing.

2 Claims, 5 Drawing Figures

SKID SHOE MOUNTING ARRANGEMENT FOR SNOW BLOWER

BACKGROUND OF THE INVENTION

This invention relates to snow blowers and more particularly to mounting of the skid shoe on the auger housing of a snow blower.

It is customary to provide a skid shoe on the auger housing of a snowblower. The skid shoe maintains the auger housing at a preset height relative to the riding surface to prevent the auger housing from getting hung up on the riding surface due to abrupt changes in surface height. Conventionally, a skid shoe is mounted at a preset height. It would be advantageous, however, to be able to vary the height of the skid shoe to accommodate different riding surface characteristics.

SUMMARY OF THE INVENTION

It is an object of the present invention to present a skid shoe mounting assembly which is height-adjustable to accommodate varying riding surface conditions.

The skid shoe is comprised of a base section fixably mounted to a vertical strut. The base section extends generally longitudinally with vertically arced ends. The vertical strut is fixably mounted to the base section at one end and has a plurality of apertures and a slot arranged such that it can be mounted to the housing of a snow blower auger section in a plurality of locations. To accommodate the skid shoe, the auger housing sidewalls have an aperture and slot arranged in a manner to provide cooperative location with the apertures and slots of the skid shoe in a variety of locations. Each skid shoe location corresponds to a different relative elevation of the skid shoe base to the auger housing.

FIGS. *3a, 3b* and *3c* are a schematic representation of the relative positions obtainable by the skid shoe.

DESCRIPTION OF THE PREFERRED EMBODIMENT

Figure 1:
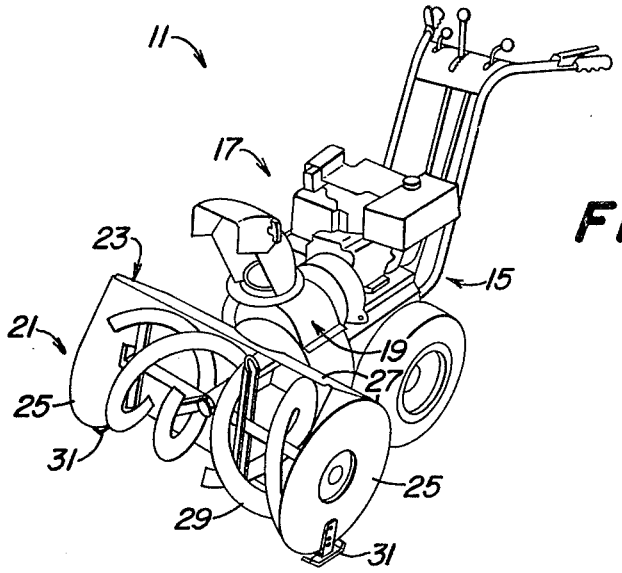
FIG. 1 is a perspective view of a snow blower.

Referring to FIG. 1, a snow blower generally indicated as 11 includes a frame 15 which has a motor 17 mounted thereto for driving an impeller 19 and auger 21 in a conventional manner. The auger 21 is comprised of a housing 23 including sidewalls 25 and an arched rear wall 27. The auger housing 27 rotatably maintains by any conventional means an auger blade 29.

Figure 2:
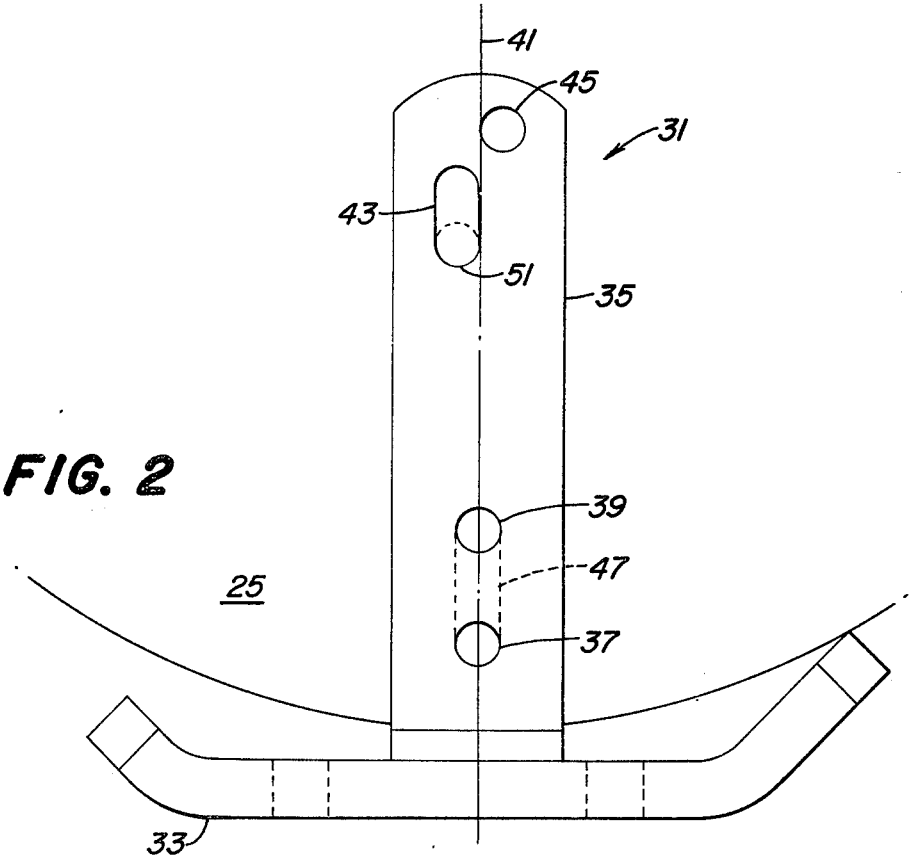
FIG. 2 is a side view of the skid shoe positioned in front of the sidewall of the auger housing in accordance with the present invention.
Figure 3A:
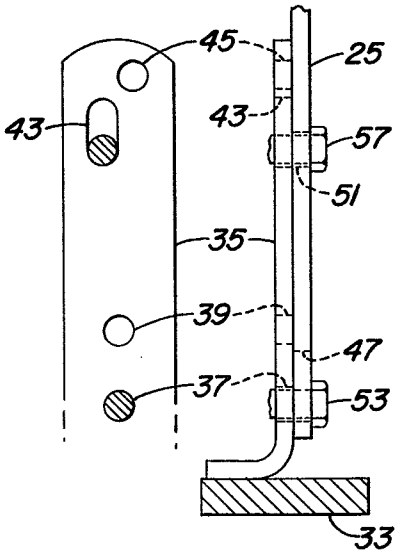
Figure 3B:
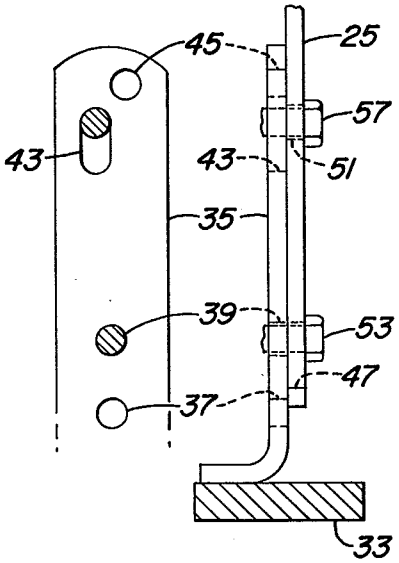
Figure 3C:
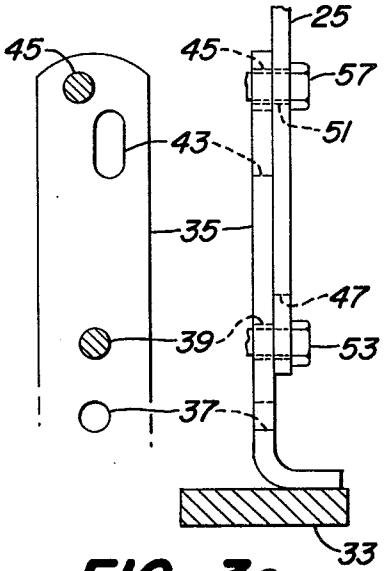

Referring more particularly to FIG. 2, a skid shoe 31 is mounted to the auger sidewall 25. The skid shoe is comprised of a base 33 having a generally longitudinal extension with vertically arced ends. A generally vertically extending strut 35 is fixably mounted to the base at one end by any conventional means. The strut 35 has a first aperture 37 and a second aperture 39 located along a vertically symmetric center line 41 of the strut 35. At the upper end of the vertical strut 35 is located a vertical extending slot 43 offset from the center line 41 to one side. A third aperture 45 is located above the slot 43 and offset from the center line 41 in opposition to the slot 43. Each wall 25 contains at its lower end a generally vertically extending slot 47 directed along center line 41 and an aperture 51 located off-set to the center line 41.

Referring to FIGS. *3a, 3b* and *3c*, to mount a skid shoe 31 to either sidewall 25 the apertures 37, 39 and 45 and slot 43 of the strut 31 can be cooperatively aligned to the slot 47 and aperture 51 of the sidewall 25 and fixably secured there by a nut bolt assembly 53 and 57 in one of a plurality of arrangements. One of said arrangements aligns aperture 51 of a sidewall 25 to slot 43 of strut 35 and slot 47 of sidewall 25 to aperture 37 of strut 35.. A second arrangement aligns aperture 51 of sidewall 25 to the upper end of slot 43 of strut 35 and slot 47 of sidewall 25 to aperture 39 of strut 35. A third position is obtained by rotating the skid shoe 37 such that aperture 51 of the sidewall 25 is aligned to aperture 45 of the strut, and slot 47 of said wall 25 is aligned to aperture 39 of the strut. These embodiments allow the skid shoe to obtain one of the three relative height positions to the sidewall 25 of the snow blower 11.

The aforedescribed preferred embodiment should not be viewed as limiting. The scope of the present invention is defined by the appendix claims.

I claim:

1. An improved skid shoe and mounting assembly for mounting said skid shoe to a respective sidewall of a snowblower auger housing said skid shoe having a base section extending generally horizontally and a strut section extending generally vertically from and fixably mounted to said base section, wherein the improvement comprises:

said strut section having sequentially aligned along the general vertical center line of said strut, a first hole, a second hole, a vertical slot and a third hole;

said slot being horizontally off-centered from said vertical center line in one direction and said third hole being horizontally offset from said vertical center line in another direction;

said sidewall having a generally vertical extending slot followed by a hole vertically spaced apart from said slot in said sidewall and horizontally displaced to one side from the vertical center line of said slot;

said strut being attachable to said sidewall in a plurality of vertical positions such that in a first of said vertical positions said first hole in said strut is aligned with said lower portion of said slot in said sidewall and said hole in said sidewall is aligned with said lower portion of said slot in said strut, in a second of said vertical positions said second hole in said strut is aligned with said upper portion of said slot in said sidewall and said hole in said wall is aligned with said upper portion of said slot in said strut, in a third of said vertical positions said second hole in said strut is aligned with said lower portion of said slot in said sidewall and said third hole in said strut is aligned with said hole in said sidewall, and means for fixably and detachably mounting said skid shoe to said sidewall such that said base of said skid shoe is below said sidewall in all of said plurality of vertical positions.

2. A skid shoe mounting assembly as claimed in claim 1 wherein said mounting means comprises a plurality of bolts extending through said aligned openings in said strut and sidewall and a nut threadably mounted to said bolts.

* * * * *

UNITED STATES PATENT AND TRADEMARK OFFICE

CERTIFICATE OF CORRECTION

PATENT NO. : 4,441,266

DATED : 10 April 1984

INVENTOR(S) : David A. Westimayer

It is certified that error appears in the above-identified patent and that said Letters Patent is hereby corrected as shown below:

Column 2, line 52, after "strut," insert -- and --.

Signed and Sealed this

*Thirtieth* Day of *April 1985*

[SEAL]

*Attest:*

DONALD J. QUIGG

*Attesting Officer*

*Acting Commissioner of Patents and Trademarks*